US007258202B1

(12) United States Patent
Rossignol

(10) Patent No.: US 7,258,202 B1
(45) Date of Patent: Aug. 21, 2007

(54) CREATION OF TEMPORARY SAFETY SPACES FOR ELEVATORS

(75) Inventor: Eric Rossignol, Dietwil (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/110,574

(22) Filed: Apr. 20, 2005

(30) Foreign Application Priority Data

May 10, 2004 (EP) ..... 04405294

(51) Int. Cl.
*B66B 5/16* (2006.01)

(52) U.S. Cl. ..... 187/351; 187/414; 187/377; 187/379; 74/54

(58) Field of Classification Search ..... 187/316, 187/356, 360, 365, 391, 414, 351; 74/517, 74/518, 502.2, 54; 200/43.08, 50.11, 50.1; 254/113, 127, 131
See application file for complete search history.

(56) References Cited

U.S. PATENT DOCUMENTS 5,411,117 A * 5/1995 Hayrinen ..... 187/360
5,773,771 A 6/1998 Chatham
6,202,801 B1 * 3/2001 Muller et al. ..... 187/401

FOREIGN PATENT DOCUMENTS

FR 99 07654 A1 12/2000
JP 2000016725 * 1/2000

* cited by examiner

*Primary Examiner*—Gene O. Crawford
*Assistant Examiner*—Stefan Kruer
(74) *Attorney, Agent, or Firm*—Schweitzer Cornman Gross & Bondell LLP

(57) ABSTRACT

The invention provides an elevator having a car movable along guide rails mounted in a shaft. The elevator comprises an inspection control station mounted on top of the car and accessible via a movable control station cover, blocking means for selectively preventing movement of the car into a safety space within the shaft and actuation means for actuating the blocking means. The actuation means is configured for concurrent movement with the control station cover. Accordingly, a temporary safety space is automatically created within the shaft as the maintenance technician opens the control station cover to move the car using the inspection control station.

11 Claims, 5 Drawing Sheets

CREATION OF TEMPORARY SAFETY SPACES FOR ELEVATORS

The present invention relates to the creation of a temporary safety space within a shaft of an elevator and in particular to a device that mechanically limits the travel of an elevator car to create the required safety space for maintenance personnel working within the elevator shaft.

BACKGROUND OF THE INVENTION

On the one hand there is continual pressure on elevator designers to reduce the space required for an installation within a building, but on the other hand the installation must meet industry standards by ensuring that an adequate safety space is provided in the overhead and pit of the shaft for maintenance personnel working in the shaft. Traditionally, these safety requirements have been met by providing an extended shaft having the appropriate safety spaces permanently installed above and below the travel path of the elevator car.

There have been recent proposals to reduce the space required by an elevator installation by removing the permanent safety spaces and instead creating temporary safety spaces only when required. U.S. Pat. No. 5,773,771 describes such a system using bolts that extend outwardly from opposing sides of the elevator car to prevent the car from moving into a particular zone or temporary safety space. When maintenance is to be carried out within the shaft, the technician mounts the roof of the car and pulls a rod at the side of the car to trigger the bolts into their extended position. The technician can then move the car at a reduced, inspection speed along the shaft using an inspection control station. The travel path of the car is restricted as the extended bolts engage with corresponding steel plates mounted at specific positions on the guide rails and the required temporary safety space is thereby established.

The objective of the present invention is to simplify the procedure for performing maintenance operations within the shaft of an elevator installation. In particular, the invention seeks to overcome the need of the maintenance technician to remember to manually activate the bolts before commencing inspection speed travel using an inspection control station mounted on the car.

BRIEF DESCRIPTION OF THE INVENTION

The present invention provides an elevator having a car movable along guide rails mounted in a shaft. The elevator comprises an inspection control station mounted on the car and blocking means for selectively preventing movement of the car into a safety space within the shaft. Access means are provided to selectively enable operable access to the inspection control panel and are configured to concurrently actuate the blocking means.

The invention also provides a method for creating a safety space in a shaft of an elevator having a car movable along guide rails mounted in the shaft. The method comprises the steps of mounting an inspection control station on the car and selectively preventing movement of the car into the safety space within the shaft using blocking means. Access to the inspection control station is selectively prevented such that accessing the inspection control station causes concurrent actuation of the blocking means.

BRIEF DESCRIPTION OF THE DRAWINGS

The invention is further described by way of the examples with reference to the accompanying drawings in which.

DETAILED DESCRIPTION OF THE INVENTION

Figure 1:
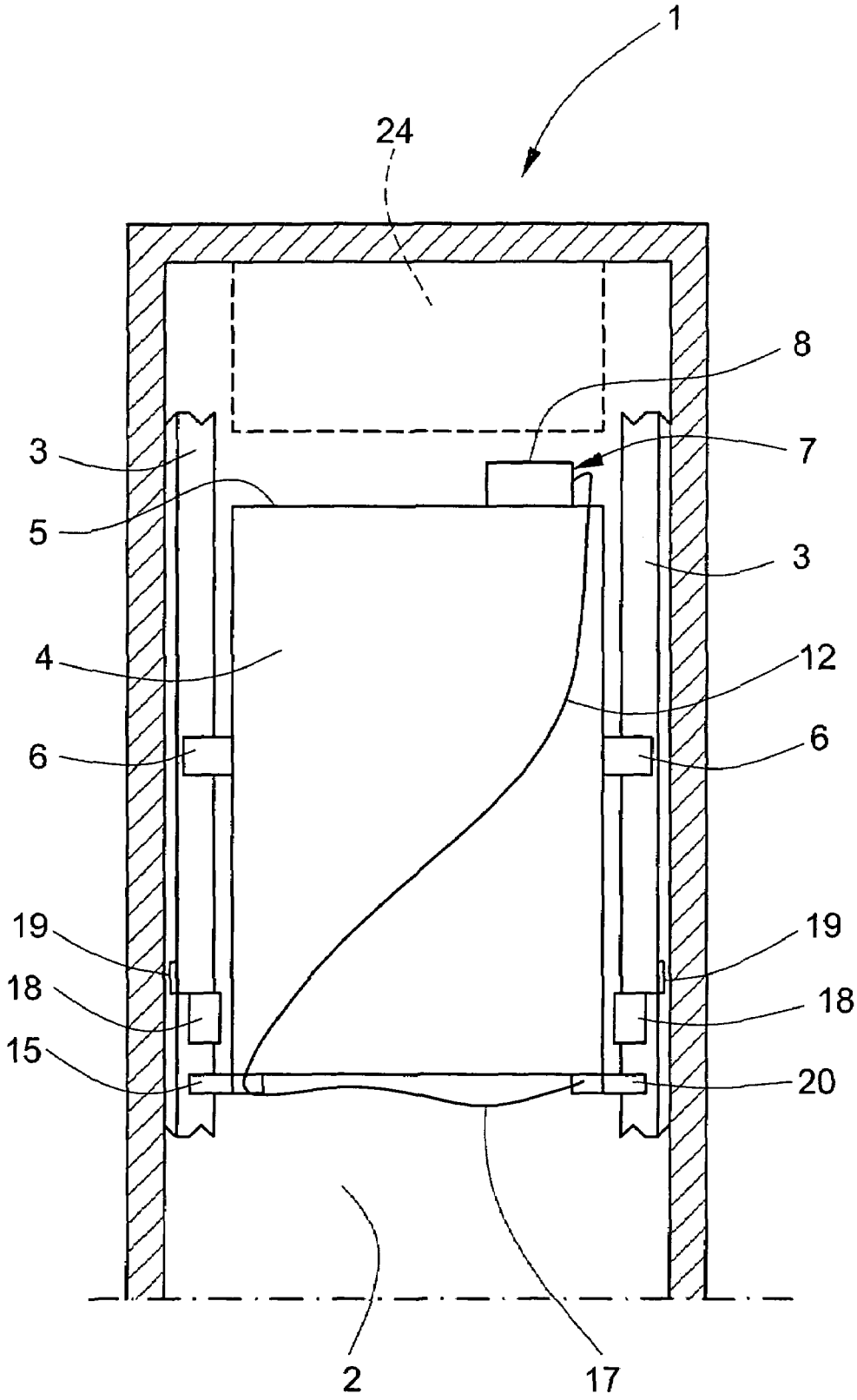
FIG. 1 is a schematic representation of an elevator according to a preferred embodiment of the present invention.

An elevator 1 according to the present invention is shown in FIG. 1 and comprises an elevator car 4 movable vertically along guide rails 3 mounted within a shaft 2. The car 4 includes guide shoes 6 to ensure that the car 4 accurately follows the path of the guide rails.

Figure 2:
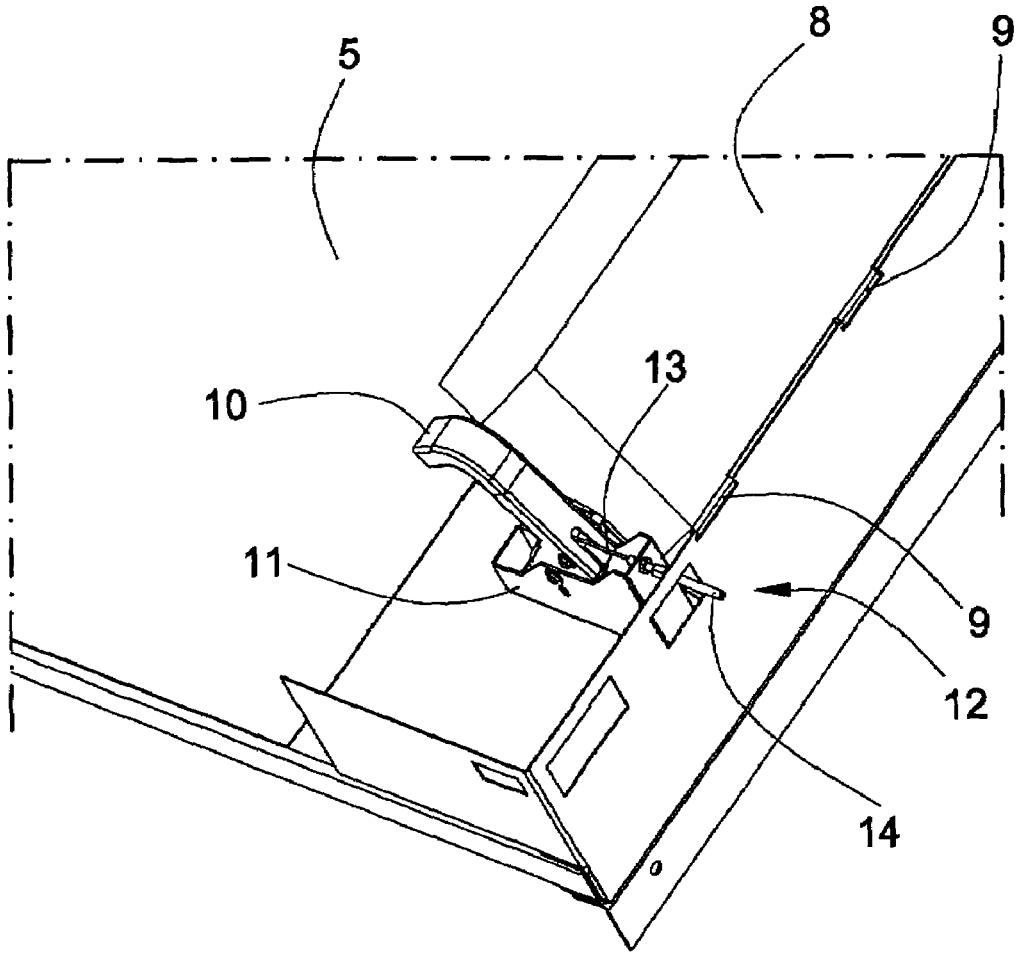
FIG. 2 is a perspective view of a portion of the inspection control station of FIG. 1.

During maintenance, a technician mounts the roof 5 of the car 4 and presses an emergency stop button (not shown). He can then move the car 4 at an inspection speed using the inspection control station 7. As shown specifically in FIG. 2, the control station 7 includes a pivotal cover 8 mounted on hinges 9. A lever 10 and support bracket 11 are mounted on the roof 5 alongside the control station cover 8. The lever 10 is interconnected, and moves concurrently, with the cover 8. The lever 10 is connected to an end of a central wire 13 of a first Bowden cable 12 while the sheath 14 of the Bowden cable 12 is fixed to the support bracket 11.

Figure 3:
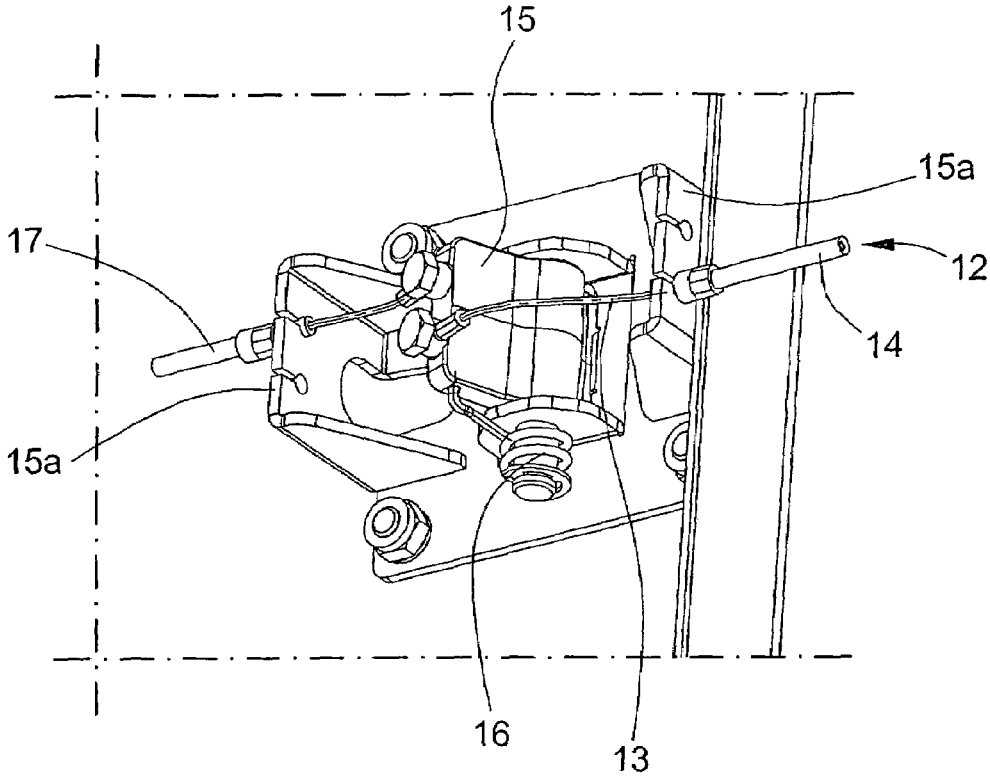
FIG. 3 is a perspective view of the arrangement of a first pivotal cam extendible from a side of the elevator car of FIG. 1.
Figure 4:
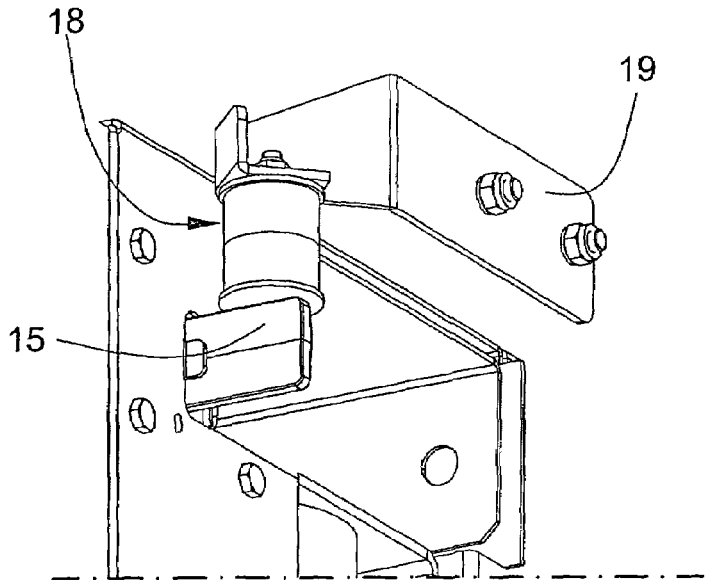
FIG. 4 is a perspective view showing the first cam in its extended position in engagement with a guide rail mounted buffer.

At the other end of the first Bowden cable 12, the central wire 13 is fixed to a first pivotal cam 15 (shown in FIG. 3) and the sheath 14 is secured to a support bracket 15*a*. The pivotal cam 15 is biased by a spring 16 towards an extended position shown in FIG. 4 where the cam 15 extends from the side of the car 4 to engage with a buffer 18 fixed by a bracket 19 to the guide rail 3 and thereby prevents further upward motion of the car 4 into the overhead safety space 24. When the first pivotal cam 15 assumes its retracted position the car 4 can travel unhampered along its normal travel path.

Figure 5:
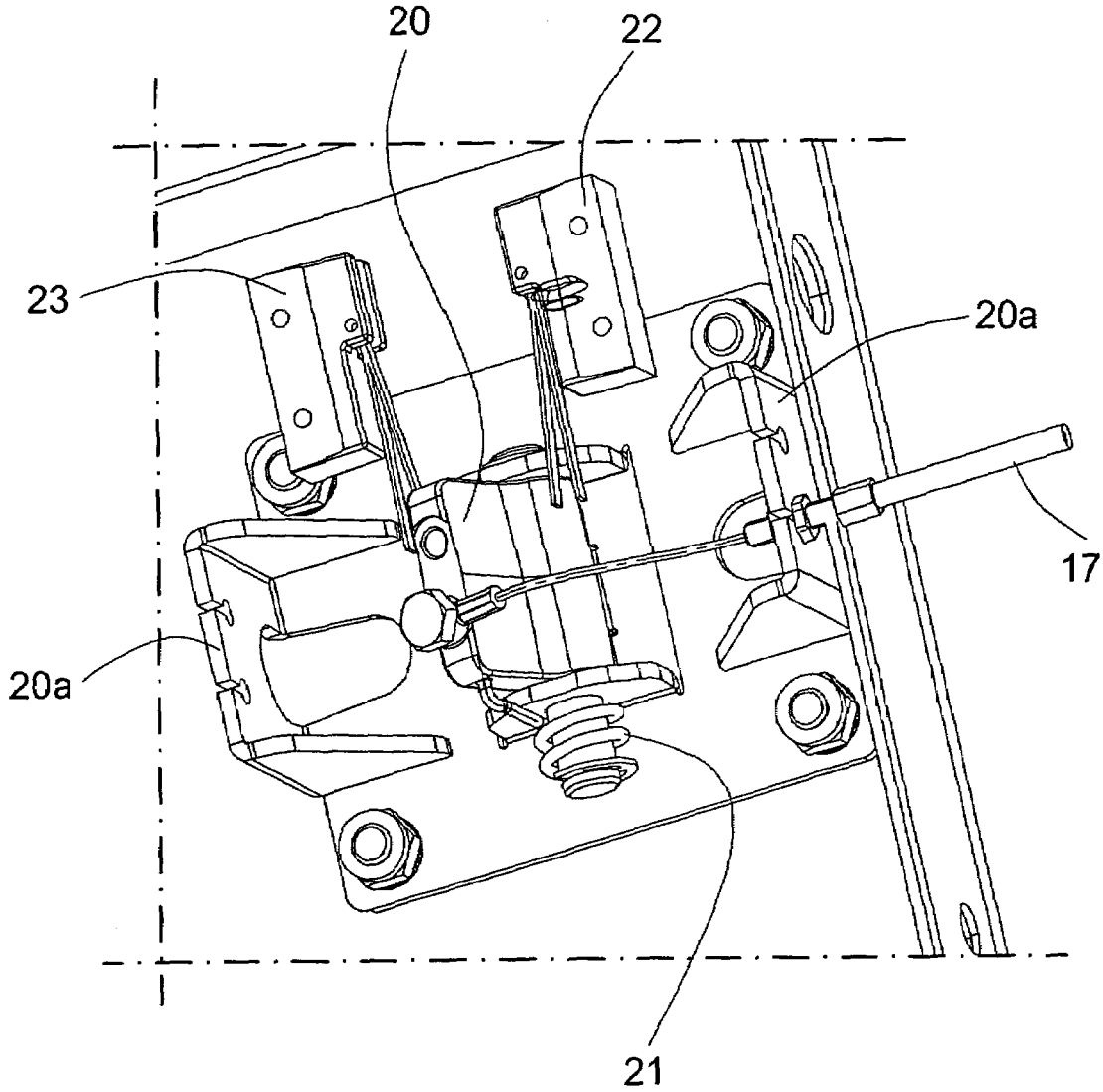
FIG. 5 is a perspective view of a second pivotal cam extendible from a side of the elevator car of FIG. 1.

A second Bowden cable 17 is arranged in the same manner between the first pivotal cam 15 and a second pivotal cam 20 provided on the opposing side of the car 4. As illustrated in FIG. 5, the second pivotal cam 20 is also biased by a spring 21 to an extended position where it extends from the side of the car 4 to engage with a buffer 18 fixed by a bracket 19 to the guide rail 3 and thereby prevents further upward motion of the car 4 into the overhead safety space 24. In the retracted position of the second pivotal cam 20 the car 4 can travel unhampered along its normal travel path. Two safety contacts or switches 22 and 23 are provided alongside the second pivotal cam 20 to indicate when the cam 20 is in the extended and retracted positions, respectively. Since the first and second cams 15 and 20 are operated in tandem, an indication of the position of the second pivotal cam 20 is sufficient to indicate the position of the first pivotal cam 15.

To carry out maintenance work from the roof 5 of the car 4, the technician manually opens a landing door using a conventional triangular key. The safety chain of the elevator control is thereby broken and the elevator 1 is placed in a STOP condition. The technician then accesses the car roof 5, presses an emergency stop button (thereby maintaining the STOP condition even if the landing door closes) and opens the cover 8 of the inspection control station 7. The lever 10 moves concurrently with the cover 8 and through this action the central wires 13 of both Bowden cables 12 and 17 relax. Accordingly, the first and second cams 15 and 20 pivot into their extended positions under the spring biases. The safety contact 22 generates a signal to the elevator controller when the second cam 20 is in the fully extended position, and the elevator 1 is released from the STOP condition to an inspection mode whereby the technician can move the car 4 at an inspection speed within the shaft 2 using the inspection control station 7. In the inspection mode the car 4 is prevented from entering the overhead safety space 24 since the pivotal cams 15 and 20 are in the extended positions and engage with the rail mounted buffers 18 if the technician attempts to move the car 4 upwards into the safety space 24.

After the required maintenance has been carried out, the technician closes the control station cover 8 and the central wires 13 of both Bowden cables 12 and 17 are moved against the biasing force of the springs 16 and 21 and the cams 15 and 20 are thereby pivoted to their retracted positions. The safety contact 23 generates a signal for the elevator controller, returning the elevator 1 from the inspection mode into a STOP condition. Thereafter the technician leaves the shaft 2 through a landing door and activates a reset button which enables the elevator 1 to resume its normal operating mode.

It will be readily understood that the above arrangement for creating the necessary temporary safety space 24 in the overhead of the shaft 2 can easily be adapted to establish a similar safety space in the pit of the shaft 2. Indeed, all that is needed are additional buffers 18 mounted on the guide rails 3 at the required level in the lower region of the shaft 2.

Furthermore, although both of the pivotal cams 15 and 20 in the described embodiment are spring biased, it is clear the same effect can be reproduced using a single biasing spring 21 on the second pivotal cam 20 only, since any movement of the second cam 20 automatically carries over to first cam 15 through the interconnecting second Bowden cable 17.

In a preferred embodiment the control station cover 8 is used to control access to the inspection control station 7. However, it will be obvious to the skilled person that any other access means is equally applicable for implementing the present invention. For example, the inspection control station 7 may not have a cover 8, in which case the inspection controls are otherwise made inoperable until the lever 10 has been moved to create the safety space. Alternatively, the inspection control station 7 may be configured so that it can only be activated by a key operated switch. In this case, the movement of the key operated switch can also be used to actuate the pivotal cams 15 and 20 into their extended positions and thereby create the required safety space. The key operated switch may be mechanically coupled to the pivotal cams 15 and 20. Alternatively, movement of the key operated switch could complete an electrical circuit to actuate the pivotal cams 15 and 20.

Figure 6:
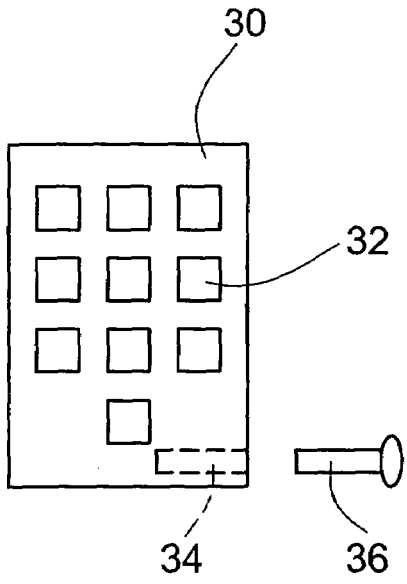
FIG. 6 is a front view of an operating panel within the elevator car according to a second embodiment of the present invention.
Figure 7:
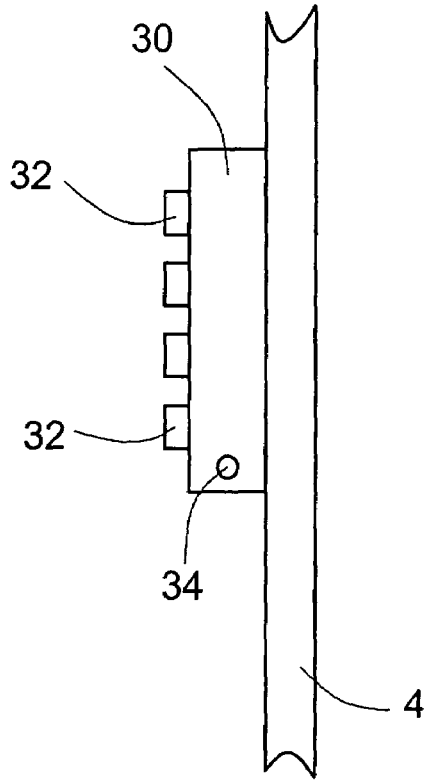
FIG. 7 is a side view of the operating panel of FIG. 6.

FIGS. 6 and 7 illustrate a further embodiment of the invention, wherein an operating panel 30 mounted in the interior of the car 4 has dual purposes. This embodiment is thought to be particularly useful with the elevator described in EP 1052212. In normal operation, it functions as a normal car operating panel whereby users register their desired destination using the pushbuttons 32 on the panel 30. In maintenance situations, the technician can insert a key 36 into a key operated switch 34 on the side of the panel 30 transforming the panel 30 into a functioning inspection control station and simultaneously actuating the pivotal cams 15 and 20.

Figure 8:
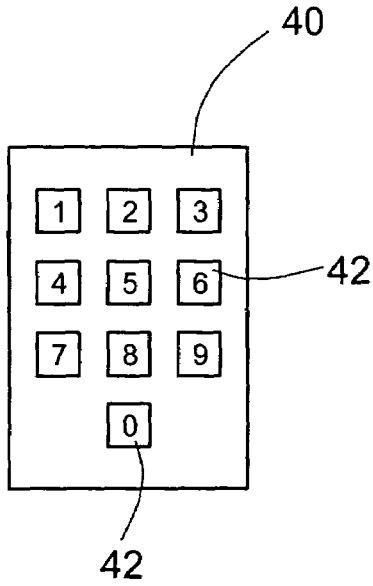
FIG. 8 is a front view of an alternative operating panel according to a third embodiment of the present invention.

FIG. 8 shows an alternative embodiment wherein the normal car operating panel 40 is transformed into a functioning inspection control station electronically by inputting a correct security code using the keypad 42 and thereby simultaneously actuating the pivotal cams 15 and 20.

Although the invention has been described with specific reference to pivotal cams 15 and 20 as the means for creating the temporary safety space, it is obvious that the invention can utilise any other blocking means which selectively prevents movement of the car into a safety space within the shaft.

I claim:

1. In an elevator of the type having a car movable along guide rails mounted in a shaft, an improvement for creating a temporary safety space comprising an inspection control station mounted on the car, blocking means for selectively preventing movement of the car into a safety space within the shaft, and access means to selectively enable operable access to the inspection control station and concurrently actuate the blocking means.

2. An elevator according to claim 1 wherein the blocking means comprise a cam mounted on the car and configured to move between an extended position and a retracted position.

3. An elevator according to claim 1 or claim 2 wherein the access means is a movable control station cover.

4. An elevator according to claim 1 or 2 wherein the inspection control station additionally functions as a car operating panel and the access means is configured to switch the inspection control station between functions.

5. An elevator according to claim 2 wherein the cam in the extended position engages with a buffer mounted on a guide rail to prevent movement of the car into the safety space.

6. An elevator according to claim 2 or claim 5 wherein the cam is spring biased towards the extended position.

7. An elevator according to claim 2 further comprising a safety contact to monitor the position of the cam.

8. An elevator according to claim 7 wherein the cam is spring biased towards the extended position.

9. An elevator according to claim 8 wherein the access means is a movable control station cover.

10. An elevator according to claim 3 further comprising a lever movable concurrently with the control station cover and a Bowden cable interconnecting the lever and the blocking means.

11. An elevator according to claim 4, wherein the access means comprise a key and a key operated switch.

* * * * *